US008082891B2

(12) United States Patent
Von Stade

(10) Patent No.: US 8,082,891 B2
(45) Date of Patent: Dec. 27, 2011

(54) CONVERSION MECHANISM FOR A PIVOTING RECIPROCATING ENGINE

(76) Inventor: Christiaan Phillippus Von Stade, Pretoria (ZA)

( * ) Notice: Subject to any disclaimer, the term of this patent is extended or adjusted under 35 U.S.C. 154(b) by 603 days.

(21) Appl. No.: 12/161,209

(22) PCT Filed: Jan. 12, 2007

(86) PCT No.: PCT/IB2007/050095

§ 371 (c)(1),
(2), (4) Date: Jul. 17, 2008

(87) PCT Pub. No.: WO2007/083254

PCT Pub. Date: Jul. 26, 2007

(65) Prior Publication Data

US 2010/0000488 A1 Jan. 7, 2010

(30) Foreign Application Priority Data

Jan. 17, 2006 (ZA) ..... 2006/00485

(51) Int. Cl.
*F01C 9/00* (2006.01)
*F02B 53/00* (2006.01)

(52) U.S. Cl. ..... 123/18 R; 123/241; 418/68

(58) Field of Classification Search ..... 123/18 R, 123/241; 418/68
See application file for complete search history.

(56) References Cited

U.S. PATENT DOCUMENTS 1,904,373 A * 4/1933 Kempthorne ..... 418/68
2,053,017 A * 9/1936 Babel ..... 123/18 R
2,964,235 A * 12/1960 Welchon ..... 417/298
3,315,648 A * 4/1967 Del Castillo ..... 123/18 R
3,451,382 A 6/1969 Huff
3,802,278 A 4/1974 Loomans
4,080,114 A 3/1978 Moriarty
4,539,941 A * 9/1985 Wang ..... 123/18 R
5,074,253 A * 12/1991 Dettwiler ..... 123/18 R
5,086,732 A 2/1992 Seno
5,107,802 A * 4/1992 Yagi et al. ..... 123/90.15
5,147,193 A * 9/1992 Larsen ..... 418/68
6,349,679 B1 * 2/2002 Mashimo et al. ..... 123/18 R
6,835,054 B2 * 12/2004 Morita ..... 418/15
2002/0170511 A1 * 11/2002 Duke ..... 123/56.3

FOREIGN PATENT DOCUMENTS

DE 2228033 12/1973
DE 2228083 A1 * 12/1973
FR 2828711 2/2003
WO WO 2004/065762 8/2004

* cited by examiner

*Primary Examiner* — Thomas Denion
*Assistant Examiner* — Mary A Davis
(74) *Attorney, Agent, or Firm* — Galbreath Law Offices, P.C.; John A. Galbreath

(57) ABSTRACT

The invention relates to a conversion mechanism for an internal combustion (11) engine. The conversion mechanism is operable to convert pivotally reciprocating motion of an output member (30) about a prime pivot axis (30.1) into rotational motion of an output shaft (40) about a rotational output axis (40.1). The conversion mechanism includes a cam housing (74) which is fast with the output member (30) for movement about the prime pivot axis (30.1) and which is pivotally displaceable relative to the output member (30) about a cam axis (74.1) which is transverse to the prime pivot axis (30.1), the cam axis (74.1) being movable with the output member (30) about the prime pivot axis (30.1), the cam housing (74) defining at least one cam member (86); and a cam follower (80) on the output shaft (40), the cam follower (80) having a wobble axis (80.1) which is titled or inclined relative to the rotational output axis (40.1).

21 Claims, 10 Drawing Sheets

CONVERSION MECHANISM FOR A PIVOTING RECIPROCATING ENGINE

THIS INVENTION relates to a conversion mechanism for an internal combustion engine for converting pivotally reciprocating motion to rotational output motion, or vice versa. The invention extends to an engine assembly and to a motor vehicle.

According to one aspect of the invention, there is provided a conversion mechanism for an internal combustion engine, the conversion mechanism being operable to convert pivotally reciprocating motion of an output member about a prime pivot axis into rotational motion of an output shaft about a rotational output axis, the conversion mechanism including:

a cam housing which is fast with the output member for movement about the prime pivot axis and which is pivotally displaceable relative to the output member about a cam axis which is transverse to the prime pivot axis, the cam axis being movable with the output member about the prime pivot axis, the cam housing defining at least one cam member; and a cam follower on the output shaft, the cam follower having a wobble axis which is titled or inclined relative to the rotational output axis, the cam member of the cam housing being in pivotally reciprocating engagement with the output member and being operable to engage the cam follower, thereby to convert the pivotally reciprocating motion of the output member to rotational motion of the output shaft about the rotational output axis.

The cam follower may be in the form of a planar wobble disc having a wobble axis which is normal to the disc and inclined at an angle relative to the rotational axis. Instead, the cam follower may be in the form of an inclined bush having a wobble axis tilted relative to the rotational axis. It is to be appreciated that the term 'wobble axis' means that, as the output shaft rotates about its rotational axis, the wobble axis, which is tilted or inclined relative to the rotational axis, appears to wobble as it revolves about the rotational axis.

The wobble axis may be inclined at an angle of about 5° to about 60° relative to the rotational axis. More particularly, the wobble axis may be inclined at an angle of about 16° relative to the rotational axis.

The wobble axis may intersect the rotational output axis, so that the wobble axis describes a double cone upon rotation of the output shaft, the double cone having its vertex at the intersection of the rotational output axis and the wobble axis. Preferably, the intersection of the wobble axis with the rotational output axis coincides with an intersection of the prime pivot axis, the prime pivot axis in such case optimally being perpendicular to the output shaft. Alternatively, the prime pivot axis may be co-axial with the rotational output axis.

The cam housing may define a passage though which the output shaft passes. The cam housing preferably provides the cam member in the form of two opposed cam faces which are parallel and are spaced along the wobble axis, the cam faces sandwiching the wobble disc between them so that the wobble disc is parallel to both the cam faces. Advantageously, the mechanism may include a low-friction interface between the wobble disc and the cam faces. The low-friction interface may comprise a pair of thrust bearings which are co-axial with both the cam faces and the wobble disc, the thrust bearings being located on opposite sides of the wobble disc for bearing against the cam faces.

It will be appreciated that, in use, the cam housing may pivot with the output member about the pivot axis, the cam housing exerting a moment on the wobble disc about the rotational output axis, thus causing rotation of the output shaft. Upon rotation of the output shaft, the wobble axis of the wobble disc, and together therewith the cam housing, will wobble about the rotational output axis, as defined above.

In other words, the cam housing may be mounted on the output member for simultaneous reciprocating pivoting about a pair of orthogonal axes, typically the prime pivot axis and the cam axis, the range of motion of the cam housing about the respective axes being equal and movement of the cam housing about the respective axes being 90° out of phase. The net effect of such simultaneous reciprocating pivoting of the cam housing about the two axes may cause the cam housing to wobble with the wobble axis about the output shaft.

Differently defined, the invention provides, in an internal combustion engine which comprises a output member which is mounted in an engine block for pivotal reciprocating motion about a prime pivot axis, and a conversion mechanism which drivingly connects the output member to a journalled output shaft, to convert the reciprocating pivotal motion of the output member into rotational motion of the output shaft, the improvement whereby the conversion mechanism includes:

a cam housing which is connected to the output member such that it is fast with the output member for movement about the prime pivot axis, but being pivotally displaceable relative to the output member about a cam axis which is transverse to the prime pivot axis;

a cam follower fast with the output shaft, the cam follower being operably engaged with the cam housing such that pivotal reciprocating motion of the output member results in the transmission of motion to the cam follower, such that:

a torque moment having an axis parallel to the output shaft is transferred to the output shaft, to rotate the output shaft;

a pivot axis moment parallel to the prime pivot axis is counteracted by journaling of the output shaft; and a cam pivot moment having an axis transverse to both the torque moment and the pivot axis moment causes pivoting of the cam housing about the cam axis.

The invention extends to an engine assembly which includes:

an internal combustion engine having an output member which is pivotally reciprocable about a prime pivot axis;

an output shaft which is rotatable about a rotational output axis; and a conversion mechanism whereby the output member and the output shaft are drivingly connected together.

The conversion mechanism may be a conversion mechanism as above defined.

The engine may include at least one piston which is movable in a cylinder for driving the output member in response to combustion of fuel in the cylinder. The piston may be in the form of a vane. In such a case, the engine may include a plurality of vanes which are equi-angularly spaced about a central hub and project radially outwardly therefrom. A major face of the vane is preferably roughly square, but may instead be round or rectangular. Each major face of the vane may each define therein a recess.

More particularly, the engine may include two diametrically opposed vanes which project radially outwardly from the hub. The output shaft may pass through the hub between the vanes, the output shaft optionally being orientated transversely or perpendicularly to the pivot axis. In another embodiment, the output shaft may be parallel to the pivot axis. The cam housing is typically housed within the hub.

The hub may be right-circular cylindrical and may be pivotally mounted or mountable in an engine block for pivotally reciprocating motion about the prime pivot axis which is co-axial with the cylindrical hub. The engine block may be of a lightweight metal, such as aluminium, or a lightweight metal alloy. A ratio of a diameter of the hub to a length of the vane may be greater than 1:1, preferably about 1.7:1.

The engine block may define cylinders shaped to accommodate pivotally reciprocating vanes. The cylinders may be arcuate or generally sector-shaped, an arcuate displacement of the cylinders, measured as an angle with the pivot axis being its vertex, depending on the angle which the wobble axis is inclined relative to the rotational axis. The arcuate displacement of the cylinders may be twice the angle by which the wobble axis is inclined relative to the rotational axis, preferably about 32°.

The engine may include a set of intake and exhaust valves on either side of the cylinder, thereby defining two combustion chambers per cylinder, one on either side of each vane. The intake and exhaust valve may be driven by a worm gear mounted to the output shaft.

In one embodiment, the engine may be a spark ignition engine and may therefore include at least one spark plug on either side of the cylinder, i.e. at least one per combustion chamber. The engine may be operable in either two-stroke or four-stroke mode. The compression ratio of the engine may be adjusted from about 10:1 to about 20:1.

In another embodiment, the engine may be a compression ignition engine.

The engine assembly may include a trochoidal oil pump having a trochoidally displaceable toothed wheel driven by the output shaft.

The invention extends to a motor vehicle which includes an engine assembly as above defined.

The invention will now be further described, by way of example, with reference to the accompanying diagrammatic drawings.

Figure 1:
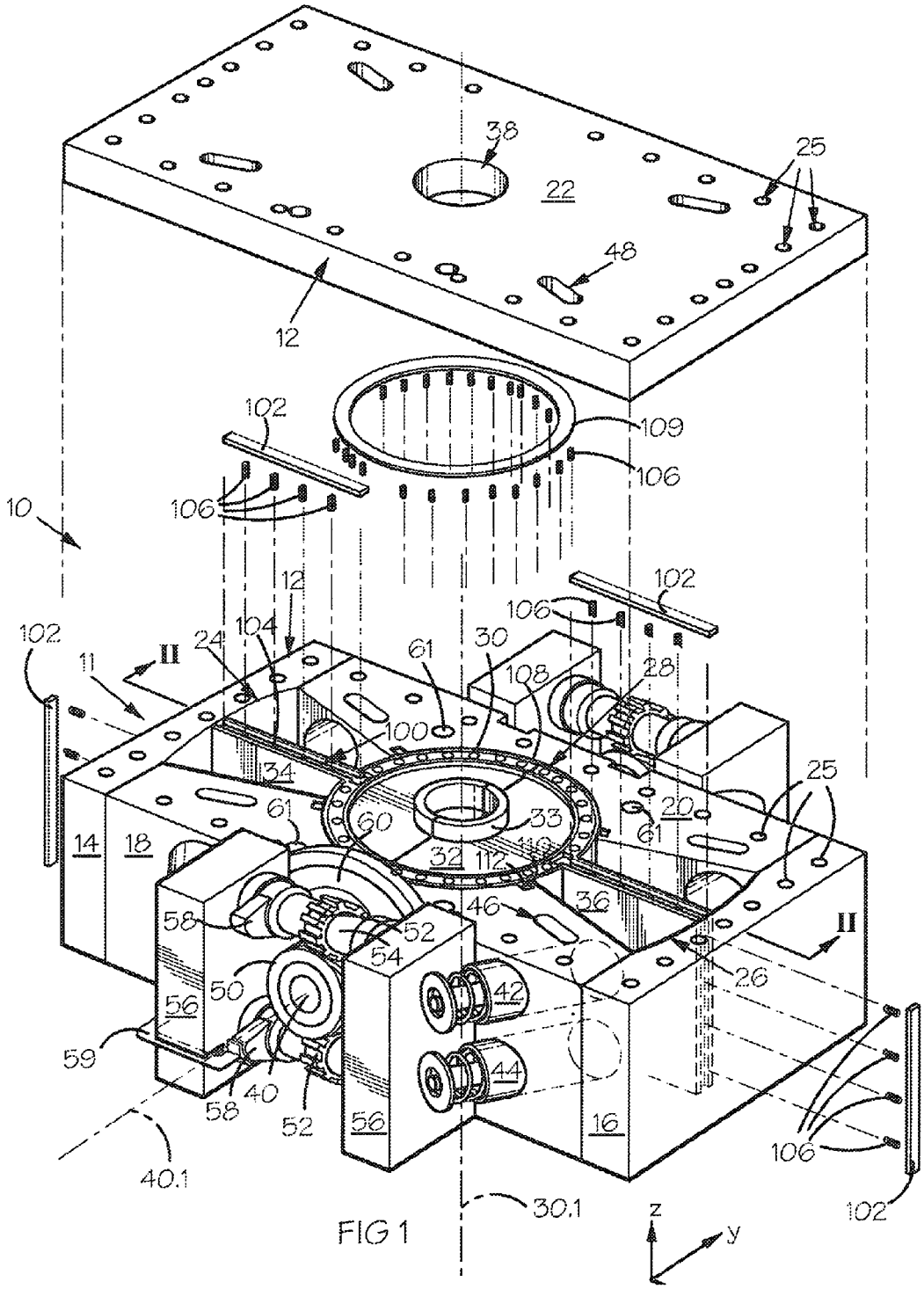
FIG. 1 shows a three-dimensional partially exploded view of an engine assembly, in accordance with the invention.
Figure 2:
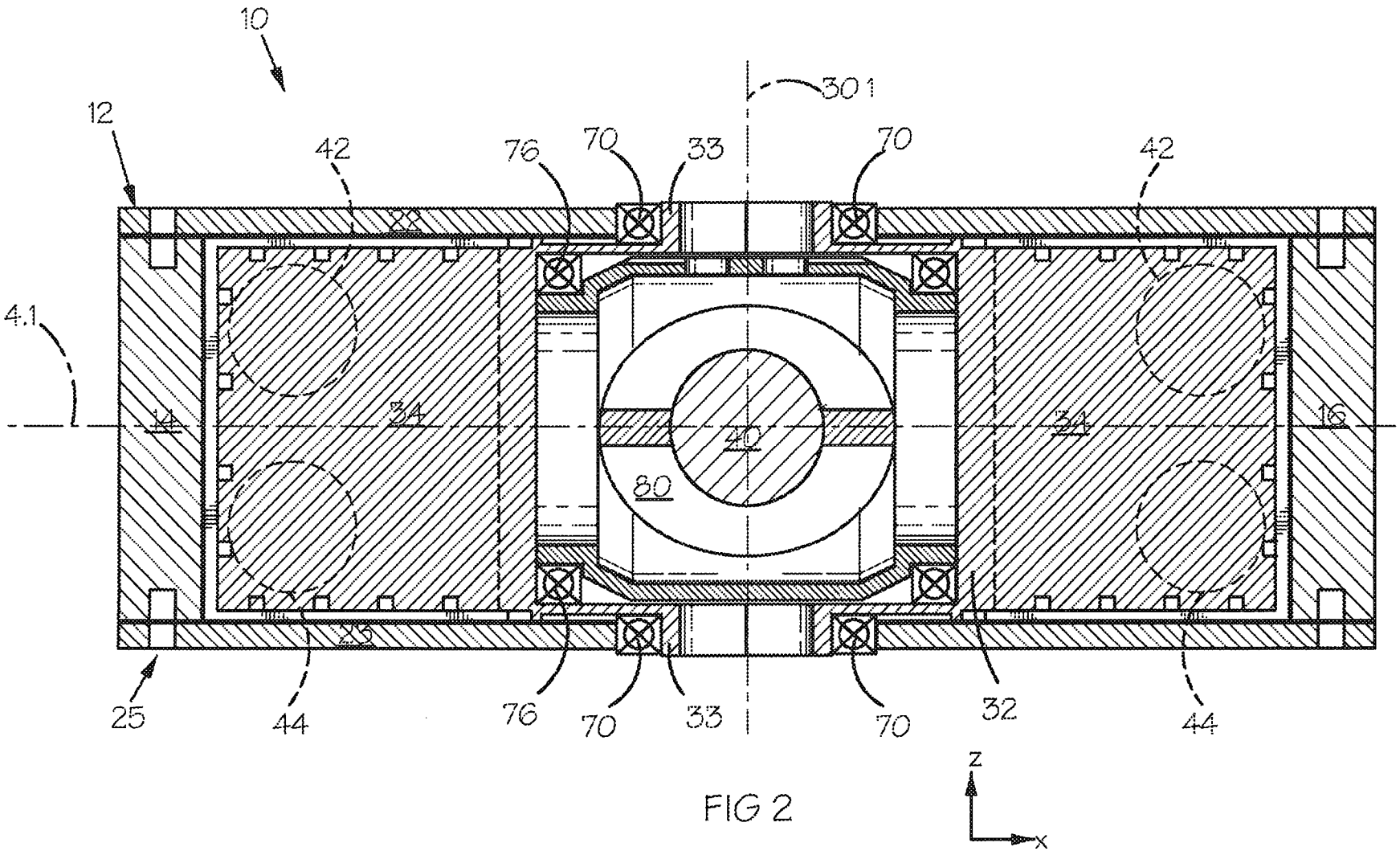
FIG. 2 shows an axial section along plane II-II of the engine of FIG. 1.

Referring to FIG. 1, reference numeral 10 generally indicates an engine assembly in accordance with the invention. The engine assembly 10 includes an internal combustion engine 11 which includes an engine block 12 which is generally right-angle parallelepiped shaped, being rectangular in top plan view. The engine block 12 is of aluminium and is therefore lightweight. The engine block 12 in this example is modular, having a pair of opposed end walls 14, 16, a pair of opposed side walls 18, 20, and opposed top and bottom walls 22, 23 (the bottom wall 23 is shown in FIG. 2). In another embodiment (not shown), one or more of the walls 14, 16, 18, 20, 22, 23 may be integral with one another. Of course, at least one of the walls is preferably removable, engine-top or cylinder head fashion, to permit initial assembly and servicing of the internal mechanisms of the engine, as described in more detail below.

The engine block 12 defines two compartments or cylinders 24, 26, and a central cylindrical cavity 28. The cylinders 24, 26 are diametrically opposed about the cylindrical cavity 28. Each cylinder 24, 26 is arcuate or generally sector-shaped in top plan view, and is rectangular in side elevation. Each cylinder 24, 26 thus has a constant height, while it increases in cross-sectional width radially outwardly from the cylindrical cavity 28 towards the end walls 14, 16. The walls 14, 16, 18, 20, 22, 23 define around their periphery a series of threaded bores 25 for receiving attachment means, such as screws, bolts and/or nuts (not shown) to fasten the walls 14, 16, 18, 20, 22, 23 to one another.

An output member, or reciprocating member, generally indicated by reference numeral 30, comprises a right-circular cylindrical hub 32 and pistons in the form of two co-planar, diametrically opposed, radially outwardly projecting vanes 34, 36. The vanes 34, 36 are relatively thin in relation to their length and height, and are thus plate-like. The vanes 34, 36 act as pistons within the cylinders 24, 26 of the engine 11, being arranged for displacement in the cylinders 24, 26 in response to the combustion of fuel in the respective cylinders 24, 26.

The cylindrical cavity 28 is complementary to the hub 32 and is thus shaped and dimensioned to receive the hub 32 snugly with a peripheral working clearance, such that the hub 32 is held captive in the cylindrical cavity 28 but is pivotally or angularly displaceable about a prime pivot axis 30.1 which is co-axial with the polar axis of the cylindrical cavity 28. The vanes 34, 36 are rectangular when seen in axial section (see FIG. 2), each vane 34, 36 being in sliding contact with the top wall 22, the bottom wall 23, and one of the end walls 24, 26. The hub 32 is made from two substantially identical halves. The ratio of the diameter of the hub 32 to the radial length of each vane 34, 36 is about 1.7:1.

An annular boss 33 projects co-axially from each axial end face of the hub 32, the boss 33 being formed by two halves provided by the respective halves of the hub 32, each boss 33 standing proud of the hub 32 and being receivable in a matched mounting aperture 38 in the top wall 22 and the bottom wall 23 respectively. The output member 30 is thus mounted in the engine assembly 10 such that it is pivotable about pivot axis 30.1. An arcuate displacement of the cylinders 24, 26, measured as an angle with the pivot axis 30.1 being the vertex, is 32°. In other words, each cylinder 24, 26 can be described by movement of the respective vane 34, 36 through 32° about the pivot axis 30.1.

An output shaft 40 (only partially shown in FIG. 1) is disposed perpendicularly to the pivot axis 30.1, so that the shaft 40 intersects the pivot axis 30.1 at right angles, the output shaft 40 passing through the hollow hub 32 (further described below). The output shaft 40 is journalled in end bearings (not shown) housed in the respective side walls 18, 20 such that the output shaft 40 is rotatable relative to the engine block 12 about an output axis 40.1.

The engine block 12 defines a set of intake valves 42 and exhaust valves 44 on either side of each cylinder 24, 26. The intake and exhaust valves 42, 44 cooperate with associated intake ports 46, 48 and outlet ports (not shown) defined by the respective side walls 18, 20. As can best be seen in FIG. 1 of the drawings, each set of intake ports 46, 48 and exhaust ports is provided in a radially oriented side face of the respective cylinder 24, 26. Each cylinder 24, 26 therefore has a set of intake and exhaust valves 42, 44 on either side of the vane 34, 36, thereby effectively providing two combustion chambers, one on either side of each vane 34, 36 (further described below). The intake ports 46, 48 are in fluid flow communication with a fuel mixture supply arrangement (not shown), such as a fuel injection system, and pass though an upper face of the engine block 12. The outlet ports are connected to an exhaust manifold (not shown) and open out of the opposite, lower face of the engine block 12. In this example, the engine 11 is a spark ignition engine and includes four spark plugs (not shown), one for each combustion chamber. Two spark plugs extend through each end wall 14, 16 respectively to a corner of each combustion chamber.

Two worm gears 50 are keyed to the output shaft 40, one on either side of the engine block 12. Each worm gear 50 meshes with two diametrically opposed gears 52 which are keyed to respective cam shafts 54. The cam shafts 54 are rotatably mounted between two operatively upright cam blocks 56 which are mounted to each side of the engine block 12. A cam 58 is fast with each end of the cam shaft 54 axially inwardly of the cam block 56. The cams 58 (of which there are eight in total, one for each valve 42, 44) drive rocker arms 59 (only one of which is shown) which extend through matched grooves in the cam block 56 and which actuate the valves 42, 44. The cams 58 on the upper cam shafts 54 actuate the intake valves 42 and the cams 58 on the lower cam shafts 54 actuate the exhaust valves 44. The cams 58 at opposed ends of the same cam shaft 54 are not aligned, thereby giving the intake valves 42 at opposite ends of each side of the engine 11 different timing.

Edge faces (i.e. the top, bottom, and end edge faces) of the vanes 34, 36 each define therein an elongated groove 100 extending along that edge to accommodate a seal 102. Each seal 102 is elongated and of cast iron having a T-shaped cross-sectional profile. In an alternative embodiment (not shown), the seal 102 could be a strip having a rectangular cross sectional profile. Each groove 100 has a plurality of longitudinally spaced blind bores 104 which extend normally to the respective edge, to accommodate helical compression springs 106 for urging the seals 102 away from the vane 34, 36 and into contact with the associated wall 14, 16, 22, 23 of the engine block 12. In other embodiments (not shown) each seal 102 is biased by means of a single elongated leaf spring.

Axially outer end faces of the hub 32 each define therein a circumferentially extending annular groove or recess 108 to accommodate an annular seal 109. The grooves 108 define therein a plurality circumferentially spaced axially extending blind bores 104 to accommodate helical compression springs 106 for urging the seals 109 away from the hub 32 into contact with the top wall 22 and the bottom wall 23 respectively.

Figure 9:
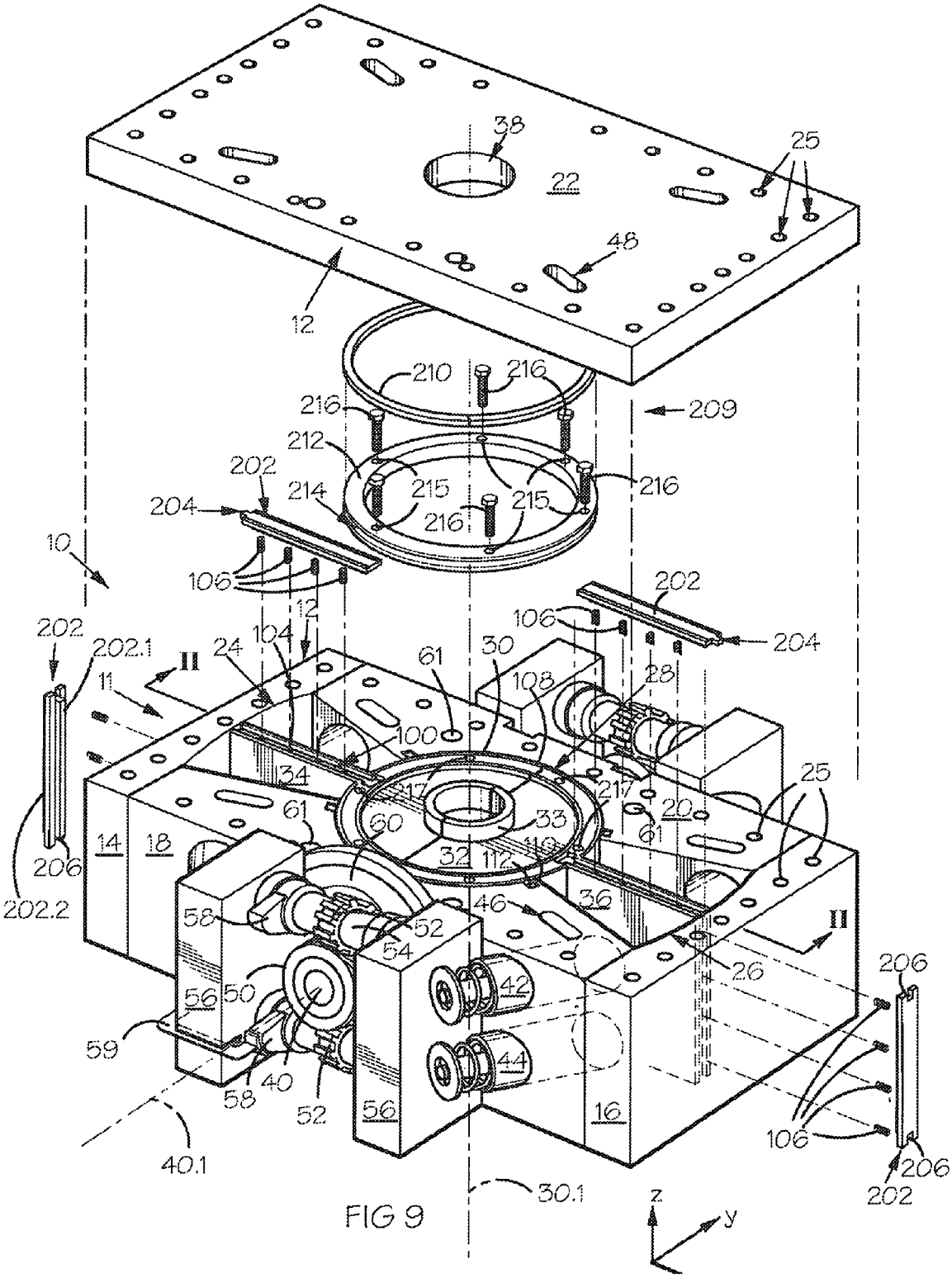
FIGS. 9 and 10 correspond to FIGS. 1 and 2 respectively but show alternative embodiments of a sealing arrangement, in accordance with the invention.
Figure 10:
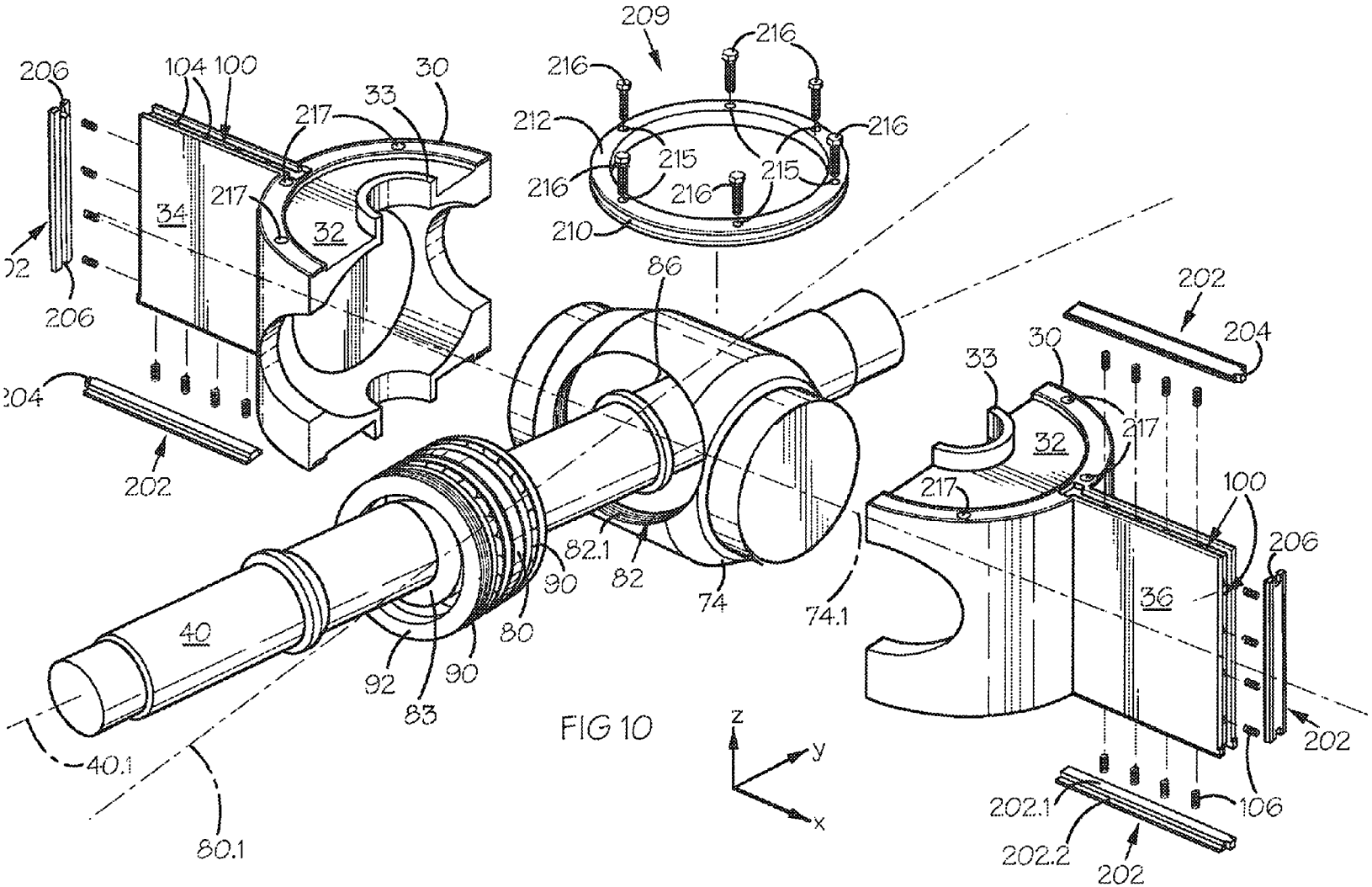

An alternative embodiment of the seal arrangements is shown in FIGS. 9 and 10. The elongated grooves 100 along the edge faces of the vanes 34, 36 accommodate, in use, a seal 202 having a T-shaped cross-sectional profile. The seal 202 thus includes a base or stem portion 202.1 and a head portion 202.2. The base portion 202.1 matched to the elongate groove 100 such that it can be accommodated snugly therein. In such a case, the head portion 202.2 projects outwardly and laterally from the groove 100 thereby being sandwiched between edge faces of the vanes 34, 36 and the engine block 12. The seals 202 are biased outwardly against inner faces of the engine block 12 in similar fashion to seals 102 of FIGS. 1 and 2.

Further, adjacent seals 202 interconnect by means of sliding dovetail-type connections. Top and bottom seals 202 each have a male dovetail connection 204 at their outer ends, while the side seals 202 each have female dovetail connections 206 at both of their ends. In use, when the seals 202 are positioned with their base 202.1 extending within the groove 100, the complementary male dovetail connections 204 and female dovetail connections 206 interconnect, thereby to form a tighter seal at corners of the vanes 34, 36.

FIGS. 9 and 10 show the engine assembly 10 to include an annular seal assembly 209 which includes an annular seal ring 210 and an annular mounting member 212. The mounting member 212 defines in a radially outer face thereof an annular recess 214 to accommodate the seal ring 210. The mounting member 212 is accommodated, in use, within the annular groove 108 defined in the axially outer end face of the hub 32 such that at least a portion of the mounting member 212 and the seal ring 210 stand axially proud of the hub 32. Although not shown, there is a similar seal assembly 209 at the bottom of the hub 32. The inner face of the top wall 22 and the bottom wall 23 define therein circular or annular recesses (not shown). The protruding portion of the mounting member 212 and the seal ring 210 are received within the circular recess such that the seal ring 210 bears radially outwardly against a radially inner face of the circular recess, thereby providing a seal between the hub 32 and the top and bottom walls 22, 23 respectively.

The mounting member 212 is secured in the groove 108 of the axially outer face of the hub 32 by a positive connection arrangement including a plurality of bolts or screws 216. The mounting member 212 defines therein a plurality of circumferentially spaced bores 215 which align with respective threaded sockets 217 defined in the groove 108 of the hub 32. Thus, the bolts or screws 216 are received within the bores 215 and are screwingly engaged with the threaded sockets 217 thereby to secure the mounting member 212 to the hub 32. The bolts or screws 216 are counter-sunk such that their respective head portions lie below an axially outer face of the mounting member 212.

Figure 8:
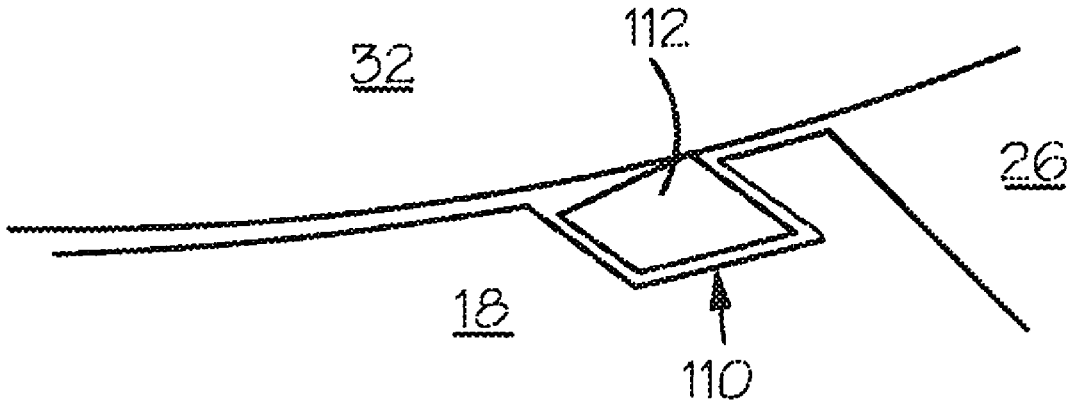
FIG. 8 shows a partial view of a seal arrangement of the engine assembly of FIG. 1.

Referring now also to FIG. 8, side walls 18, 20 of the engine block 12 additionally define therein four axially extending angularly spaced grooves 110 in the radially outer periphery of the cylindrical cavity 28. The grooves 110 extend axially relative to the pivot axis 30.1 and accommodate respective radial seals 112. The radial seals 112 are elongate and have quadrangular cross-sectional profiles. The radial seal 112 has a sealing face which is directed towards the hub 32, the sealing face being inclined relative to the tangent of the hub 32 at its point of contact with the hub 32, when the radial seal 112 is seen in cross-section, so that the radial seal 112 and the hub 32 abut along an axially extending line of sealing contact. The line of sealing contact is preferably located on a high-pressure side of the radial seal 112, the remainder of the sealing face diverging from the radially outer surface of the hub 32 on the low pressure side of the radial seal 112, In use, the line of sealing contact will thus be positioned on the side of the radial seal 112 which is closest to the adjacent cylinder defined by the engine block 12.

The seals 102, 109, 112 (and 204, 210) are of cast iron or may, instead, be of another suitable material.

A trochoidal oil pump 60 (only partially shown) includes an outer ring gear having eleven radially inwardly projecting rounded teeth, the outer ring gear being fast with the engine block 12. An inner ring gear, or conjugate gear, has ten radially outwardly projecting rounded teeth, and a plurality of radially inwardly projecting teeth. The inwardly projecting teeth of the inner ring gear mesh at a single point with teeth on the output shaft 40, the inner ring gear therefore being driven by the output shaft 40. The inner ring gear follows an epicycloidal path about the output shaft 40, and a hypocycloidal path within the outer ring gear. As the curved teeth of the inner ring gear mesh consecutively with the curved teeth of the outer ring gear, oil is forced between the respective curved teeth and forced into guided oil paths to lubricate the hub 32 and other moving parts. The engine block 12 defines therein a plurality of oil guide paths, some of which can be seen in the form of bores 61.

Referring now to FIG. 2, the walls 14, 16, 18, 20, 22, 23 of the engine block 12 are shown fitted together. The hub 32 is pivotally mounted in the engine block 12 via journalled bearings 70. The journal bearings 70 are co-axial with the pivot axis 30.1, to permit reciprocating pivotal movement of the hub 32 about the pivot axis 30.1.

The hub 32 is hollow, and a cam housing 74 is mounted inside the hub 32. The cam housing 74 is fast with the hub 32 for movement with the hub about the pivot axis 30.1. However, the cam housing 74 is pivotally mounted on the hub 32, via journal bearings 76, to pivot about a cam axis 74.1 which is normal to the pivot axis 30.1. The cam axis 74.1 intersects both the output shaft 40 and the pivot axis 30.1. The cam housing 74 is therefore able to pivot relative to the engine block 12 about two orthogonal axes: the pivot axis 30.1 with the output member 30; and the cam axis 74.1 relative to the output member 30.

The cam axis 74.1 is also transverse to the rotational axis 40.1. In this example, the rotational axis 40.1 is normal to the pivot axis 30.1. It will be appreciated that, in other embodiments of the invention, the pivot axis 30.1 and the rotational axis 40.1 can be co-axial.

The output shaft 40 has fixed thereto a disc 80 which is inclined relative to the rotational axis 40.1 (further described below).

Figure 3:
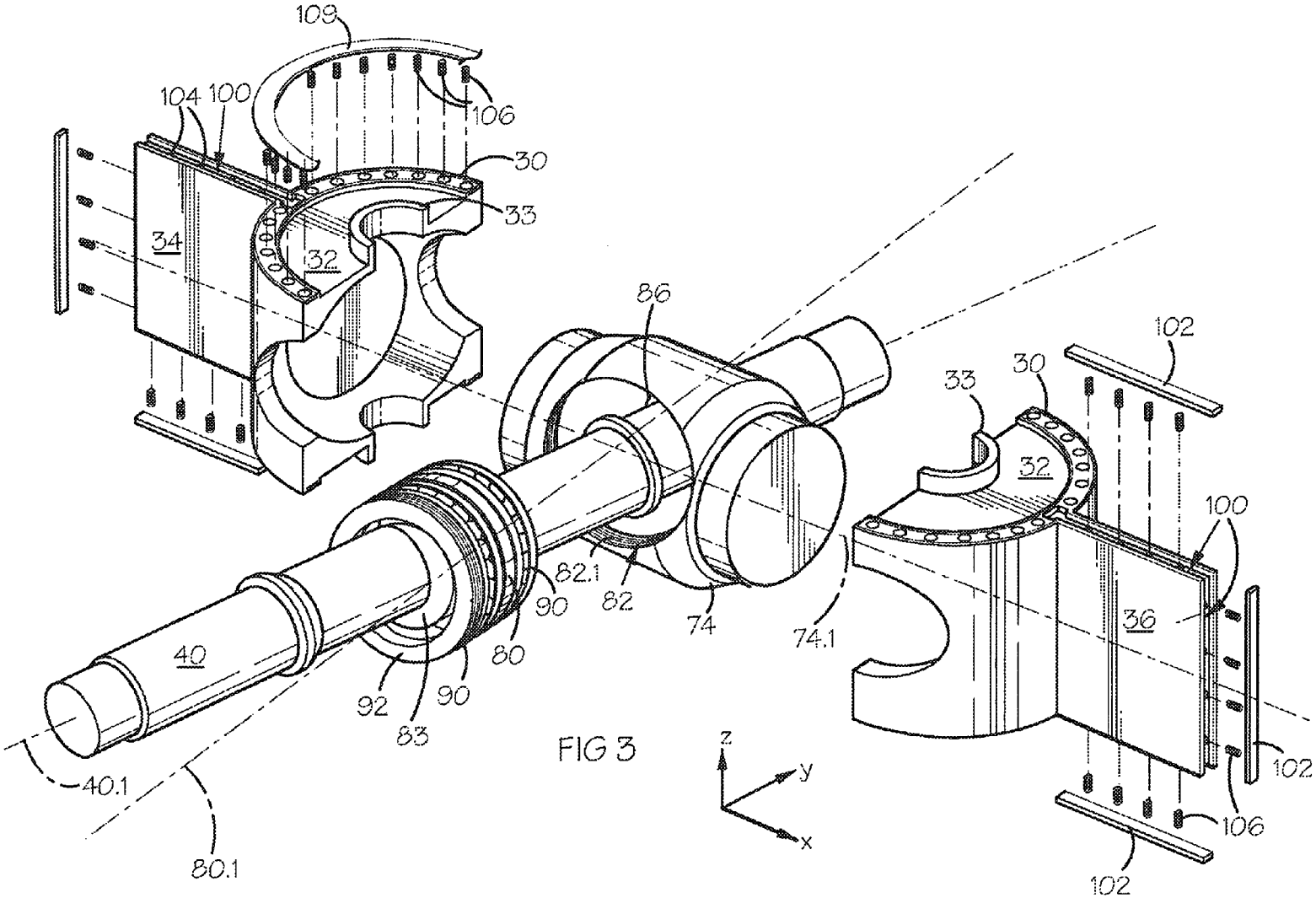
FIG. 3 shows a partially exploded view of a conversion mechanism forming part of the engine assembly of FIG. 1, in accordance with the invention.
Figure 4:
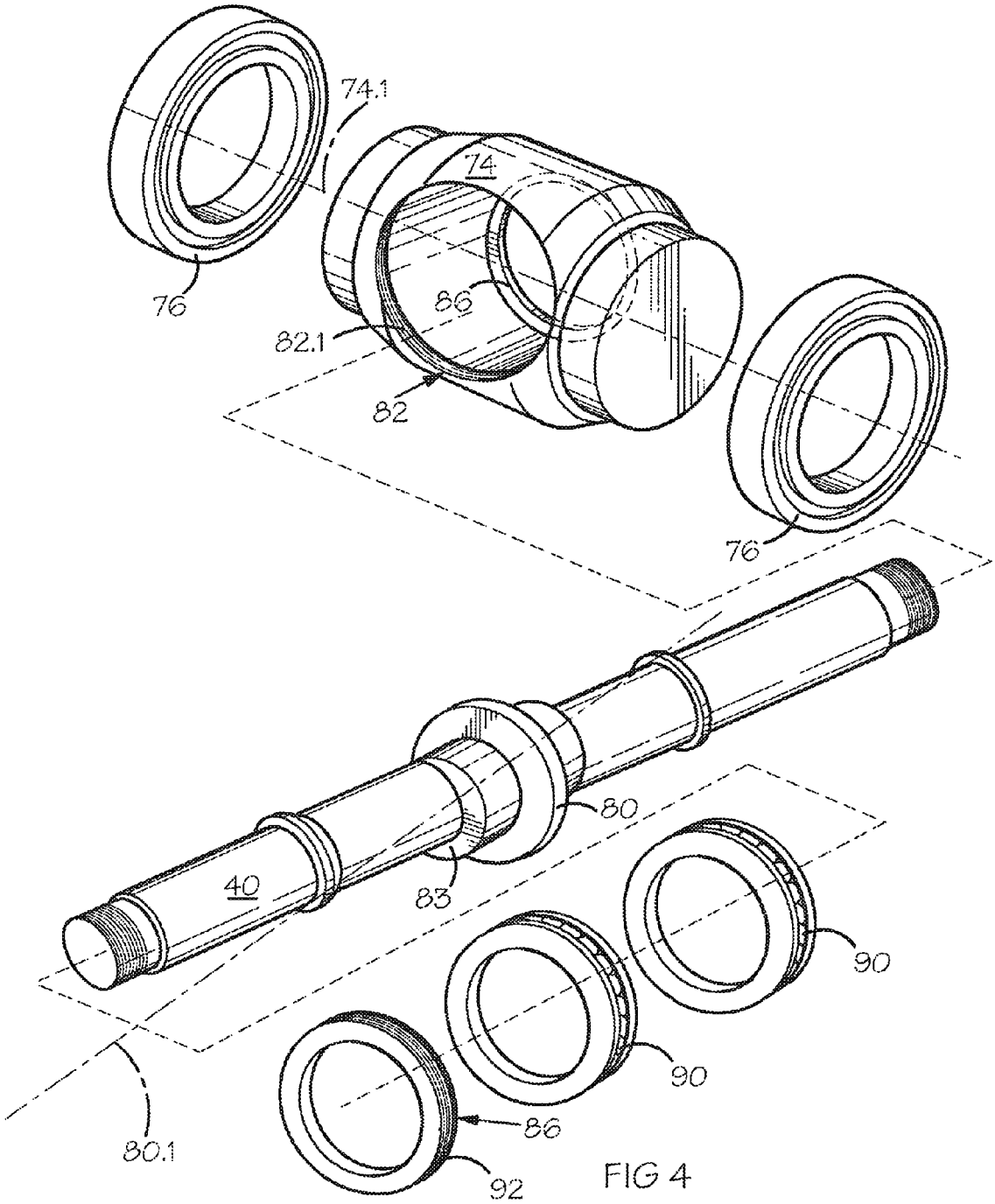
FIG. 4 shows a further exploded view of a part of the conversion mechanism of FIG. 3.

FIGS. 3 and 4 show greater detail of the output member 30, the cam housing 74 and the output shaft 40, which together comprise a conversion mechanism. The output member 30 is shown in two separated identical halves, while the output shaft 40 is shown in retracted from the interior of the cam housing 74. In operation, the disc 80 is received in the interior of the cam housing 74.

Figure 5:
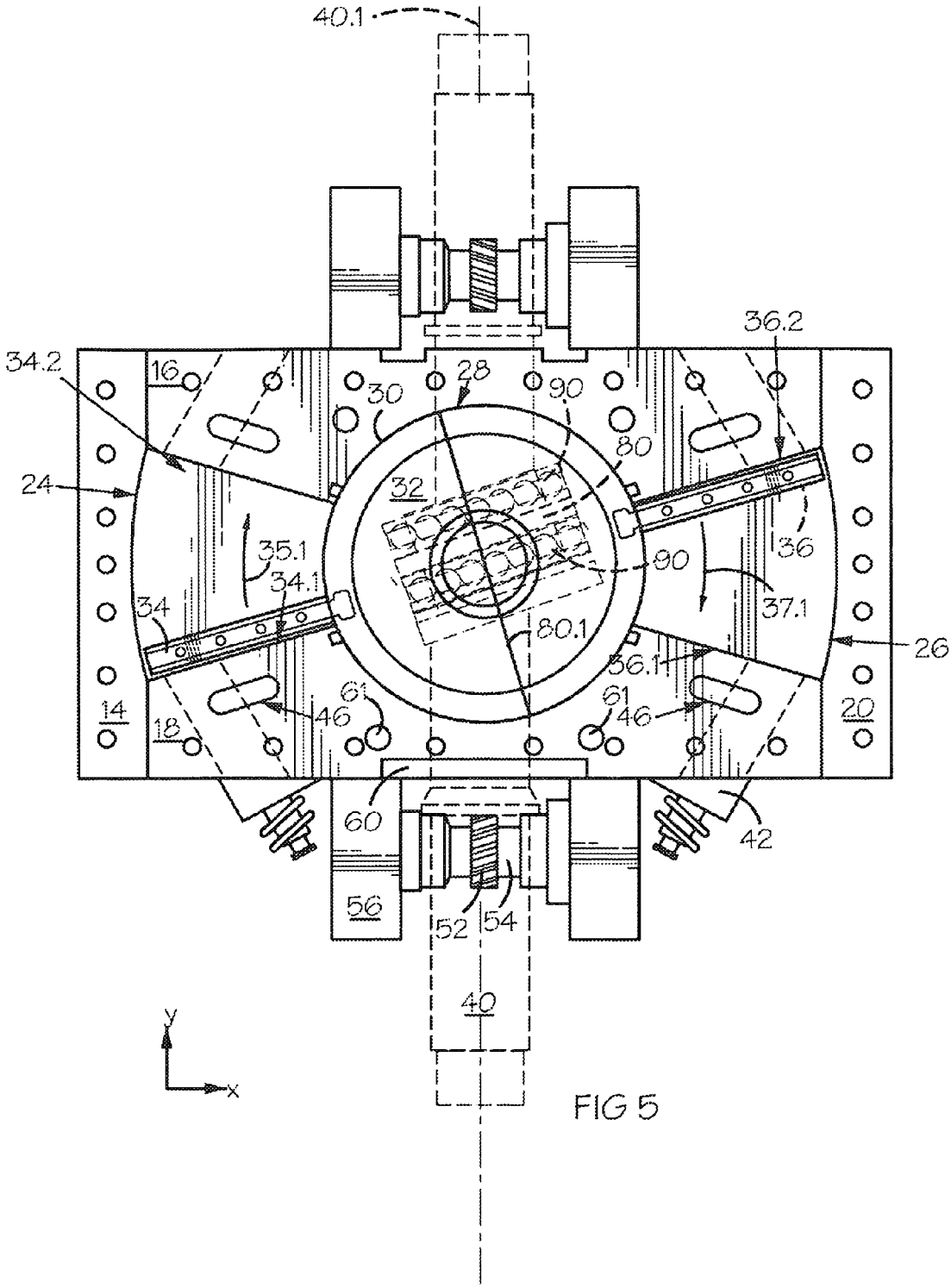
FIGS. 5 to 7 show respective top plan views of the engine of FIG. 1, with a reciprocating piston forming part of the engine assembly, being shown in various positions during a single phase in its operation.

The output shaft 40 passes through a passage 82 defined in the cam housing 74. For illustrative purposes, FIGS. 3-5 show a wobble axis 80.1 which is normal to the inclined disc 80. In the illustrated embodiment, the wobble axis 80.1 is tilted relative to the rotational axis 40.1 by an angle of 16°. Thrust bearings 90 are positioned on either side of the inclined disc 80, the thrust bearings 90 located on a cylindrical seat 83 which is co-axial with the wobble axis 80.1. A circular mouth 82.1 at one end of the passage is threaded complementarily to a screw-threaded locking ring 92. When the locking ring 92 is screwingly attached to the mouth 82.1, the inclined disc 80 and the thrust bearings 90 are held axially captive within the cam housing 74.

The cam housing 74 defines two inwardly directed axially spaced or side walls 86 within the passage 82. One of the side walls 86 is provided by an axially inner surface of the locking ring 92. The side walls 86 are arranged to bear against the thrust bearings 90, so that, when assembled, the disc 80 is sandwiched between the thrust bearings 90 which are, in turn, sandwiched between the opposed and parallel side walls 86. The side walls 86, thrust bearings 90, and disc 80 thus, in use, are forced to remain in a parallel face-to-face spatial relationship, co-axial with the wobble axis 80.1.

The side walls 86 bear against the inclined disc 80 via the thrust bearings 90, the side walls 86 therefore in use acting as cam members or cam faces and the inclined disc 80 as a cam follower, with frictionless, or low-friction, sliding movement of the disc 80 relative to the side walls 86 being permitted by action of the thrust bearings 90.

Figure 6:
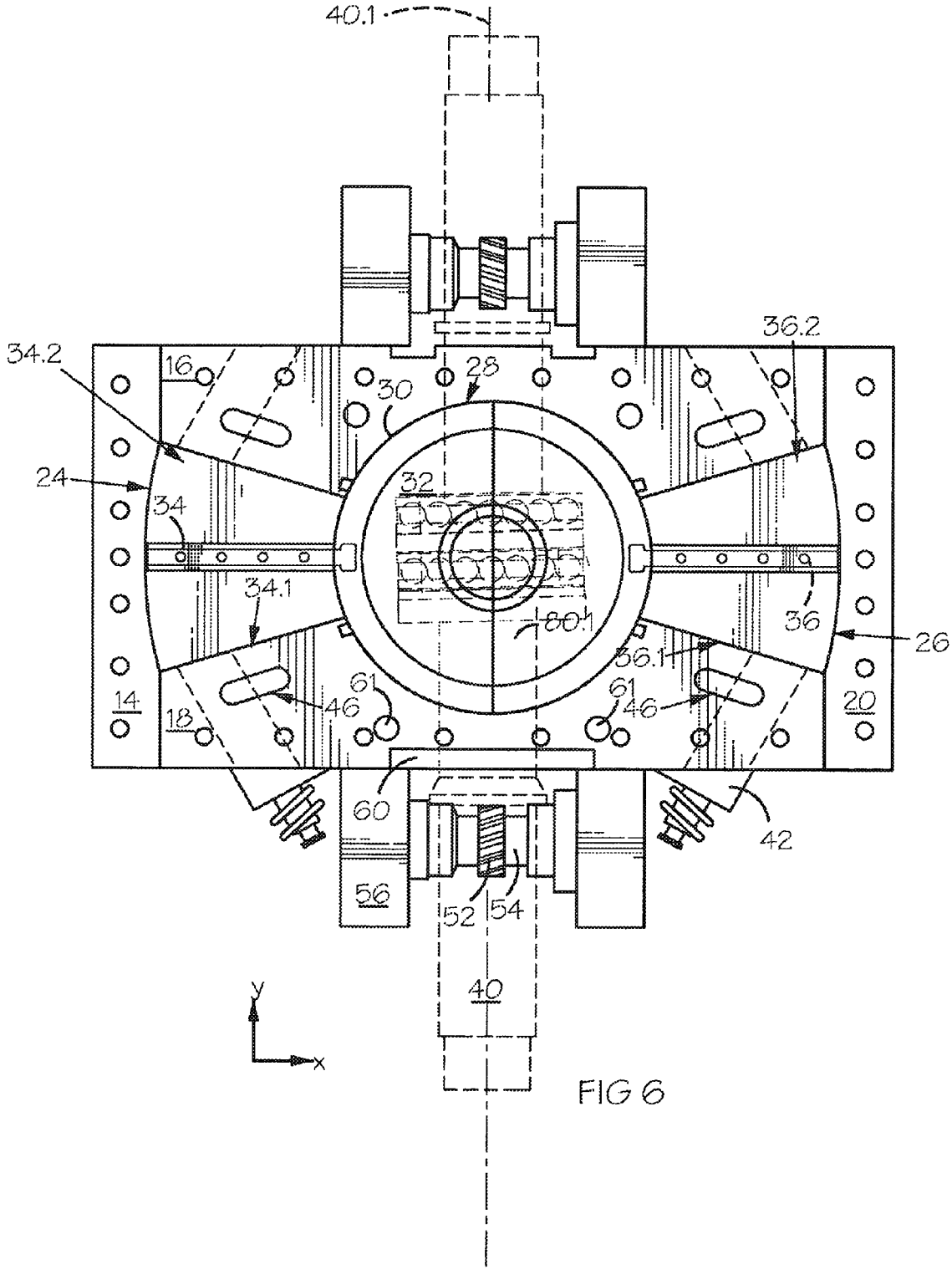
Figure 7:
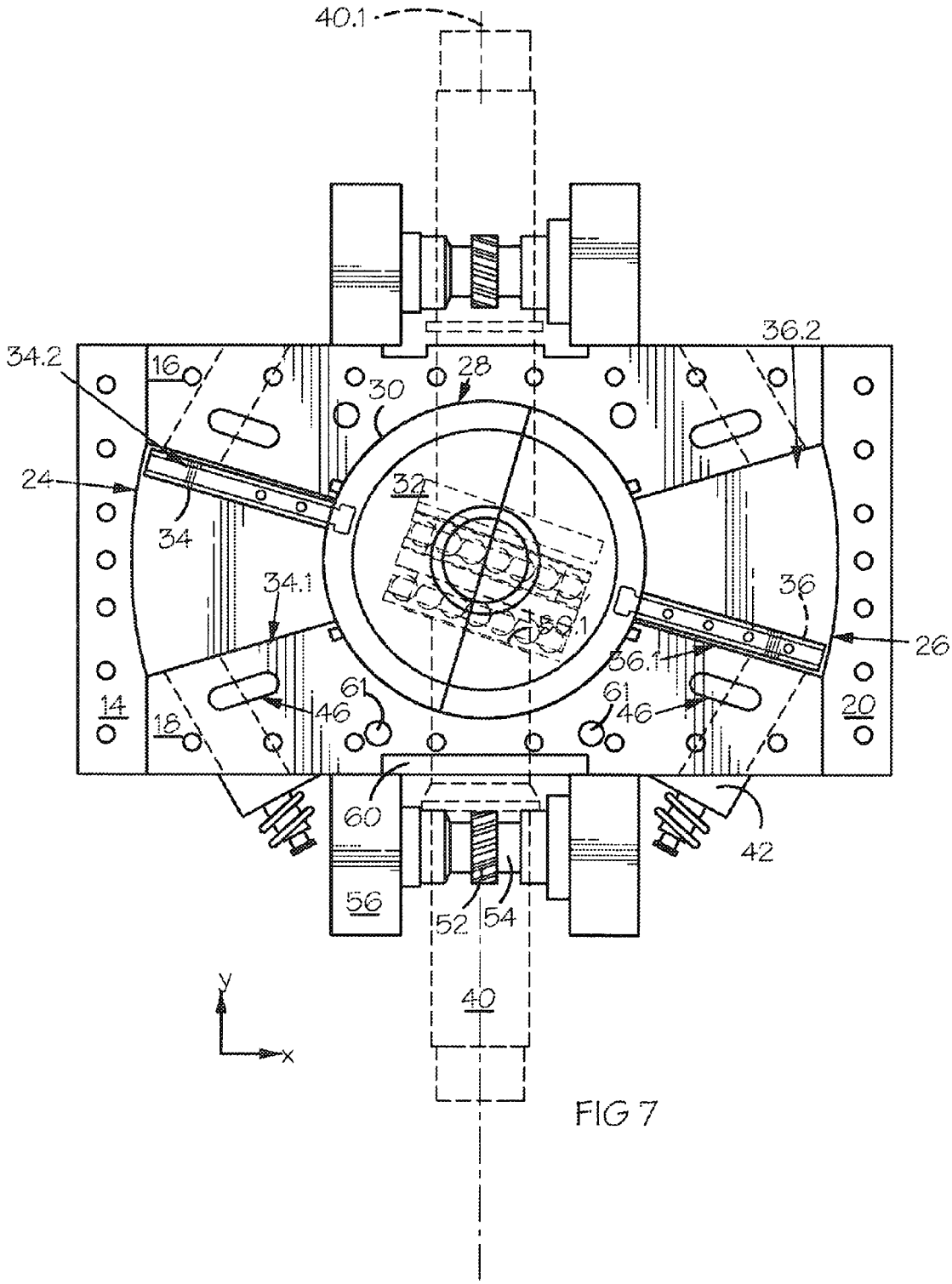

In use, and referring now to FIGS. 5, 6, and 7, the engine 11 is started in conventional fashion by externally rotating the output shaft 40 about the rotational axis 40.1. In a first operative position, shown in FIG. 5, the vanes 34, 36 are adjacent one side of their respective cylinders 24, 26. The engine 11 can operate in either two-stroke mode or four-stroke mode. In two-stroke mode, a fuel-air mixture in two combustion chambers (the chamber formed between one side of a vane 34, 36 and a portion of the cylinder adjacent that side of the vane 34, 36) is ignited simultaneously. However, the following description focuses on four-stroke mode. Also, the engine 11 can use as fuel petrol or diesel, i.e. be spark or compression ignition, but the following description describes the operation of the engine 11 using petrol. The engine 11 in this configuration has a compression ratio of about 10:1.

A fuel-air mixture, fed through the intake port 56 via the intake valve 42, is compressed in a first combustion chamber 34.1. A spark plug (not shown) sparks in the combustion chamber 34.1 igniting the fuel-air mixture in conventional fashion. The fuel-air mixture expands, displacing the vane 34 in a direction indicated by arrow 35.1, and hence causes the output member 30 to pivot about pivot axis 30.1.

The cam housing 74 moves with the output member 30 about the pivot axis 30.1 due to its pivotal connection to the output member 30, as described above, The cam faces 86 of the cam housing 74 bear against the inclined disc 80 (the cam follower) via the thrust bearings 90. When the vane 34 is at one extremity of its stroke (referred to further as top dead centre, for ease of description), as shown in FIG. 5, the wobble axis 80.1 of the inclined disc 80 lies in a plane perpendicular to the pivot axis 30.1 and intersecting the rotational axis 40.1.

It is to be appreciated that engagement of the cam housing 74 with the disc 80 is such that the orientation of the cam housing 74 must follow that of the disc 80. Because the output shaft 40 is journalled in the engine block 12, movement of the cam housing 74 and the disc 80 is linked to rotation of the output shaft 40, their orientation remaining perpendicular to the wobble axis 80.1. Upon rotation of the output shaft 40, either due to forces transferred to it from the output member 30 or due to the shaft's momentum, the wobble axis 80.1 is rotated about the rotational axis 40.1. As the wobble axis 80.1 intersects the rotational axis 40.1 at the centre of the cam housing 74, the wobble axis 80.1 describes a conical path co-axial with the rotational axis 40.1 and having its vertex at the centre of the cam housing 74.

The output member 30, when propelled by combustion in the chamber 34.1, thus exerts a moment on the cam housing 74 about pivot axis 30.1. It will be appreciated that forces between the cam housing 74 and the disc 80 are perpendicular to the interacting faces, thus being parallel to the wobble axis 801. For ease of explanation, these forces can be represented by a pair of forces which act on diametrically opposite parts of the periphery of the disc 80, the forces acting in opposite directions and being parallel to the wobble axis 80.1. Each of these forces can be reduced to component forces in three orthogonal axes. For ease of description, the two axes which are visible in FIG. 5 are referred to as the x-axis and the y-axis, while the two axes of FIG. 2 are the x-axis and the z-axis. In other words, the output shaft 40 lies in the x-y plane, while the pivot axis 30.1 lies in the x-z plane.

It will be appreciated that only the z-component of the cam forces will create a moment about the rotational axis 40.1, and that the remaining forces will either result in pivoting of the cam housing 74 about the cam axis 74.1 or be counteracted by the shaft bearings.

When the output member 30 is thus at top dead center (FIG. 5), the wobble axis 80.1 lies wholly in the x-y plane, so that the z-component of the cam forces is zero, no rotational moment thus being exerted on the output shaft 40. However, the inclined disc 80 is carried past the dead centre by the momentum of the output shaft 40 (or by the external rotation of the output shaft 40 when the engine 11 is started). The conversion mechanism passes the dead centre as the output member 30 pivots in the direction indicated by arrow 35.1.

As the engine 11 moves into an orientation shown in FIG. 6, the wobble axis 80.1 moves out of the x-y plane, so that the z-components of the cam forces result in turning of the output shaft 40 by the output member 30 via the conversion mechanism. During such movement, the cam housing 74 simultaneously pivots about the pivot axis 30.1 and about the cam axis 74.1.

At the same time, an air-fuel mixture already present in combustion chamber 36.1 is being compressed by the vane 36 moving in a direction indicated by arrow 37.1. As the output shaft 40 rotates, it drives the worm gears 50, which mesh with the gears 52 to rotate the cams 58 about the cam shafts 54. One cam 58 displaces the rocker arm 59 associated with the intake valve 58 of combustion chamber 36.2, and displacement of the vane 36 in the direction of the arrow 37.1 therefore draws fuel-air mixture into the chamber 36.2.

Chamber 34.2 contains exhaust gas, and a rocker arm 59 opens the exhaust valve 44 associated with chamber 34.2, and the displacement of the vane 34 in the direction of the arrow 35.1 exhausts the exhaust gas from the chamber 34.2.

As the ignited fuel-air mixture in the chamber 34.1 continues to expand, the output member 30 is displaced further, into the orientation shown in FIG. 7, in which the vane 34, 36 are at an opposite end of their strokes. For ease of reference, this position is referred to as bottom dead centre. During movement towards bottom dead centre, the cam faces 86 continue to bear against the inclined disc 80, causing rotation of the output shaft 40 and wobbling movement of the cam housing 74. The wobble axis 80.1 is thus further revolved about the rotational axis 40.1, and again, at bottom dead centre, passes through the x-y plane. At bottom dead centre, however, the wobble axis 80.1 is in a position symmetrically opposite to its position at top dead centre, having been rotated through 1800 along its path. As mentioned above, the pivotal motion of the cam housing about both the pivot axis 30.1 and the cam axis 74.1 effectively causes the cam housing 74 to wobble with the wobble axis 80.1 about the output shaft 40, thus accommodating the changing orientations of the inclined disc 80. The cam housing 74 pivots a total of 32° about the cam axis, corresponding to the range of motion of the vane 34, 36 from top dead centre to bottom dead centre. It can be seen from the example that the inclination of the wobble axis 80.1 relative to the rotational axis 40.1 (resulting from the orientation of the inclined disc 80) is half the angular displacement of the output member 30 about its pivot axis 30.1 to cause 180° rotation of the output shaft 40.

At bottom dead centre, no net moment is again exerted on the output shaft 40, but the output shaft 40 rotates past the bottom dead centre because of its angular momentum. At bottom dead centre, the output member 30 changes the direction of its movement about the pivot axis 30.1, because of the momentum of the output shaft 40 and/or a flywheel connected to it.

The fuel-air mixture in chamber 36.1 is now compressed, and the above described process is repeated, with the fuel-air mixture in chamber 36.1 being ignited.

Although the output member 30 moves from bottom dead centre to top dead centre in a direction opposite to its movement from top dead centre to bottom dead centre, the output shaft 40 is rotated in the same direction by the output member 30 via the converting arrangement. This is due to the inclined disc 80 having an opposite inclination relative to the output shaft 40 when viewed in the y-z plane. The cam forces are thus exerted on opposite sides of the disc 80 relative the cam forces during opposite movement, the resultant couple or moment transferred to the output shaft 40 being of similar magnitude and orientation to that transferred during opposite pivotal movement of the output member 30.

Although a chamber firing order of 34.1->36.1->36.2->34.2 is described, the engine 11 may have any convenient firing order, based on the timing of the valves 42, 44 and firing of the spark plugs.

As the output shaft 40 rotates, it drives the inner ring gear of the trochoidal oil pump 60 thereby distributing oil throughout the engine block 12.

In other embodiments of the invention, the disc 80 can be replaced by a seat or collar on which one or more thrust bearings are mounted for cam engagement with the cam housing 74.

The Inventor believes that the invention as exemplified has a number of advantages. The engine is relatively compact, and therefore has a high power to weight ratio. Furthermore, the pivotally reciprocating vane configuration provides two combustion chambers per cylinder, thereby increasing the power output of the engine.

Importantly, the conversion mechanism is operable to convert effectively the pivotally reciprocating motion of the output member into rotational motion of the output shaft. The conversion mechanism is relatively compact, being housed within the hub of the output member.

Also, the engine may use as fuel either petrol by adjusting the compression ratio to about 10:1, or diesel by adjusting the compression ratio to about 20:1. The configuration of the combustions chambers further allows the engine to be configured for either two-stroke mode or four-stroke operation.

Further, the Inventor believes that the engine is well-suited for use of hydrogen as fuel and by virtue of its configuration will be more stable when using hydrogen than a conventional piston engine.

The invention claimed is:

1. An engine assembly which includes an internal combustion engine having an output member which is pivotally reciprocable about a prime pivot axis; an output shaft which is rotatable about a rotational output axis; a conversion mechanism whereby the output member and the output shaft are drivingly connected together; and a worm gear mounted to the output shaft and which is in drive communication with at least one intake and at least one exhaust valve associated with the internal combustion engine, and wherein the conversion mechanism is operable to convert pivotally reciprocating motion of the output member about the prime pivot axis into rotational motion of the output shaft about the rotational output axis, the conversion mechanism including:

a cam housing which is fastened to the output member for movement about the prime pivot axis and which is pivotally displaceable relative to the output member about a cam axis which is transverse to the prime pivot axis, the cam axis being movable with the output member about the prime pivot axis, the cam housing defining at least one cam member; and a cam follower on the output shaft, the cam follower having a wobble axis which is tilted or inclined relative to the rotational output axis, the cam member of the cam housing being in pivotally reciprocating engagement with the output member and being operable to engage the cam follower, thereby to convert the pivotally reciprocating motion of the output member to rotational motion of the output shaft about the rotational output axis, and wherein the cam housing defines a passage though which the output shaft passes, and the cam housing provides the cam member in the form of two opposed cam faces which are parallel and are spaced along the wobble axis, the cam faces sandwiching a wobble disc between them so that the wobble disc is parallel to both the cam faces, and including a low-friction interface between the wobble disc and the cam faces, the low-friction interface comprising a pair of thrust bearings which are co-axial with both the cam faces and the wobble disc, the thrust bearings being located on opposite sides of the wobble disc for bearing against the cam faces.

2. An engine assembly as claimed in claim 1, wherein the engine includes at least one piston which is movable in a cylinder for driving the output member in response to combustion of fuel in the cylinder.

3. An engine assembly as claimed in claim 2, in which the piston is in the form of a vane.

4. An engine assembly as claimed in claim 1, wherein the engine includes a plurality of vanes which are equi-angularly spaced about a central hub and project radially outwardly therefrom.

5. An engine assembly as claimed in claim 4, in which the engine includes two diametrically opposed vanes which project radially outwardly from the hub.

6. An engine assembly as claimed in claim 4, in which the output shaft passes through the hub between the vanes.

7. An engine assembly as claimed in claim 4, in which the hub is right-circular cylindrical and is pivotally mounted or mountable in an engine block for pivotally reciprocating motion about the prime pivot axis which is co-axial with the cylindrical hub.

8. An engine assembly as claimed in claim 7, in which the engine block is of a lightweight metal or alloy.

9. An engine assembly as claimed in claim 7, in which the engine block defines cylinders shaped to accommodate pivotally reciprocating vanes.

10. An engine assembly as claimed in claim 1, wherein a set of intake and exhaust valves comprises of one of the at least one intake valve and one of the at least one exhaust valve where the set of intake and exhaust valves are positioned on either side of the cylinder, thereby defining two combustion chambers per cylinder, one on either side of each vane.

11. An engine assembly as claimed in claim 1, in which the engine is a spark ignition engine.

12. An engine assembly as claimed in claim 1, in which the engine is operable in either two-stroke or four-stroke mode.

13. An engine assembly as claimed in claim 1 wherein the engine is a compression ignition engine.

14. A conversion mechanism as claimed in claim 1, in which the cam follower is in the form of a planar wobble disc having the wobble axis which is normal to the planar wobble disc and inclined at an angle relative to the rotational axis.

15. A conversion mechanism as claimed in claim 14, in which the wobble axis is inclined at an angle of 5° to 60° relative to the rotational axis.

16. A conversion mechanism as claimed in claim 14, in which the wobble axis is inclined at an angle of 16° relative to the rotational axis.

17. An engine assembly as claimed in claim 16, in which the arcuate displacement of the cylinders are twice the angle by which the wobble axis is inclined relative to the rotational axis.

18. An engine assembly as claimed in claim 17, in which the cylinders are arcuate or generally sector-shaped, an arcuate displacement of the cylinders, measured as an angle with the pivot axis being its vertex, depending on the angle which the wobble axis is inclined relative to the rotational axis.

19. A conversion mechanism as claimed in claim 14, in which the wobble axis intersects the rotational output axis, so that the wobble axis describes a double cone upon rotation of the output shaft, the double cone having its vertex at the intersection of the rotational output axis and the wobble axis.

20. A conversion mechanism as claimed in claim 19, in which the intersection of the wobble axis with the rotational output axis coincides with an intersection of the prime pivot axis, the prime pivot axis in such case being perpendicular to the output shaft.

21. A motor vehicle which includes an engine assembly as claimed in claim 1.

* * * * *